US006802636B1

(12) United States Patent
Bailey, Jr.

(10) Patent No.: US 6,802,636 B1
(45) Date of Patent: Oct. 12, 2004

(54) ILLUMINATED RECREATIONAL BOARD

(76) Inventor: Richard B Bailey, Jr., 8620 Gold Coast Dr., San Diego, CA (US) 92126-3608

( * ) Notice: Subject to any disclaimer, the term of this patent is extended or adjusted under 35 U.S.C. 154(b) by 0 days.

(21) Appl. No.: 10/261,287

(22) Filed: Sep. 30, 2002

(51) Int. Cl.[7] ..... F21V 7/04

(52) U.S. Cl. ..... 362/555; 362/545; 362/486; 280/841; 280/87.042; D21/765; D21/766

(58) Field of Search ..... 362/555, 545, 362/486; 280/841, 87.042; D21/765, 766

(56) References Cited

U.S. PATENT DOCUMENTS

| | | | | |
|---|---|---|---|---|
| 2,140,224 A | | 12/1938 | Galgoczy | |
| 2,502,566 A | | 4/1950 | Hooley | |
| 4,298,910 A | | 11/1981 | Price | |
| 4,336,573 A | | 6/1982 | Carter | |
| 4,991,066 A | | 2/1991 | McCowan | |
| 4,997,196 A | * | 3/1991 | Wood | 280/87.042 |
| 5,004,256 A | | 4/1991 | Won | |
| 5,067,058 A | | 11/1991 | Standley | |
| 5,132,883 A | * | 7/1992 | La Lumandier | 362/466 |
| 5,292,141 A | | 3/1994 | Ekedal et al. | |
| 5,475,572 A | | 12/1995 | Tseng | |
| 5,513,080 A | | 4/1996 | Magle et al. | |
| 5,580,093 A | | 12/1996 | Conway | |
| 5,718,499 A | | 2/1998 | De Caro | |

* cited by examiner

*Primary Examiner*—Stephen Husar
*Assistant Examiner*—B. Zeade
(74) *Attorney, Agent, or Firm*—Michael I. Kroll

(57) ABSTRACT

An illuminated recreational board including a board including a top side, bottom side and peripheral side extending between said top and bottom sides. A plurality of recesses extend into the peripheral side of the board and a plurality of removable LED's positioned within respective ones of the plurality of recesses. A transparent cover is positioned on the peripheral side for protecting and covering the LED's. The LED's are connected to a device for illuminating the plurality of LED's in any of a number of different illumination sequences. The predetermined sequences include a flashing sequence, a strobing sequence, a twinkling sequence and a constant and continuous sequence. The recreational board may be formed as either a skateboard or a snowboard.

15 Claims, 9 Drawing Sheets

ILLUMINATED RECREATIONAL BOARD

BACKGROUND OF THE INVENTION

1. Field of the Invention

The present invention relates generally to recreational devices and, more specifically, to an illuminated recreational skateboard or snowboard including a flat surface having a plurality of recesses made in the peripheral edge of the surface whereby a plurality of LED's may be placed in respective recesses to provide optical displays. Additionally, a transparent or pigmented lining formed from a polymeric substance can be placed over the LED's for protecting the LED's or diffracting light illuminating from the LED's.

2. Description of the Prior Art

Numerous types of recreation devices have been provided in the prior art. For example, U.S. Pat. Nos. 2,140,224; 2,502,566; 4,298,910; 4,336,573; 4,991,066; 4,997,196; 5,004,256; 5,067,058; 5,132,883; 5,292,148; 5,475,572; 5,513,080; 5,580,093; and 5,718,499 are all illustrative of such prior art. While these units may be suitable for the particular purpose to which they address, they would not be as suitable for the purposes of the present invention as heretofore described.

U.S. Pat. No. 2,140,224

Inventor: M. Galgoczy

Issued: Dec. 13, 1938

In a construction of the class described, a roller skate comprising a frame embodying front and rear rollers, and a source of illumination supported on the frame between the front and rear rollers, and depending from the frame in a position to focus the light beam on the floor.

U.S. Pat. No. 2,502,566

Inventor: G. L. Hooley

Issued: Apr. 4, 1950

A light for roller skates, comprising a cylindrical battery casing to be mounted beneath the foot support plate of the skate between the front and rear wheels of the skate, the cylindrical battery casing having its longitudinal axis disposed horizontally and extending transversely of the foot support plate, a substantially U-shaped bracket secured to the side of the cylindrical battery casing and extending longitudinally thereof, the bracket including opposed arms extending radially upwardly from the battery casing and provided near their free ends with notches to receive the opposite longitudinal edges of the foot support plate for detachably securing the battery casing to such plate, a light bulb socket secured to the side of the cylindrical battery casing and spaced circumferentially from the bracket substantially 90 degrees, the socket projecting radially forwardly and having its axis, disposed horizontally, a translucent cap mounted upon the socket and projecting forwardly thereof, a light bulb mounted within the socket and disposed inside of the cap, the bulb having a terminal projecting radially into the side of the battery casing near the longitudinal center of the casing, a battery mounted within the casing and having an end terminal close to one end of the casing, an L shaped conductor electrically connected with the end terminal of the battery with the terminal of the bulb projecting into the battery casing, a removable cap for the end of the battery casing remote from the end terminal of the battery, and a switch device carried by the cap and including an element shiftable axially of the casing into and out of contact with the adjacent end of the battery for closing and opening the circuit through the bulb.

U.S. Pat. No. 4,298,910

Inventor: Robert T. Price

Issued: Nov. 3, 1981

A roller skate wheel has an inner body portion for securement to the axle of the roller skate and an outer body rotatable about the inner body on appropriate bearings. A permanent magnet is secured to the inner body in flux coupling relationship with electrically conducting windings carried on the outer body. When the wheel rotates, electricity is generated on the windings and used to energize light emitting diodes carried on the outer body of the wheels. The generated electricity is of the alternating type and since the light emitting diodes are essentially polarity-sensitive, they will be energized on only positive half cycles of the current to thereby provide a flashing or stroboscopic effect.

U.S. Pat. No. 4,336,573

Inventor: Leonard C. Carter

Issued: Jun. 22, 1982

Disclosed herein is an illuminated skate such as a skateboard, a roller skate or the like including a person carrying platform under which is provided a pair of axles supported from the platform upon which in rolling engagement is provided wheels thereon. Further, a source of power is disposed on the bottom surface of the person carrying platform which is operatively connected to a light source in such a manner that the underside of the skate is illuminated, and in particular, the wheels being formed of translucent material are capable of transmitting the light generated by the source along outer faces thereof.

U.S. Pat. No. 4,991,066

Inventor: Gregory L. McCowen

Issued: Feb. 5, 1991

A skateboard lighting adaptor kit that is mountable to a conventional skateboard having a deck with front and rear wheel assemblies, the lighting kit including head lights mountable to the underside of the deck proximate the front wheel assembly, tail lights mountable to the underside of the deck proximate the rear wheel assembly, and side running lights mountable to the sides of the deck, the kit including electronic control means to allow the side running lights to be selectively lighted to signal a turn.

U.S. Pat. No. 4,997,196

Inventor: John L. Wood

Issued: Mar. 5, 1991

Improvements to a skateboard comprise a board having a complete string of LED's embedded in a groove around the periphery of the skateboard in the first embodiment, powered by a microcontroller and a battery mounted to the underside of the board. In the second embodiment, along the same lines, a kit is provided wherein skid bars have the LED's mounted in them, connected by wiring leading to the microcontroller and battery. The kit can be sold for after-market use, and may consist of just the two sideboards, or the rear skid board as well, often called the kick board.

U.S. Pat. No. 5,004,256

Inventor: John Won

Issued: Apr. 2, 1991

A combination of a skateboard and electronic device for generating sound and/or light. The electronic device is affixed under the skateboard and a switch means is provided that can be operated by stepping on an operating element thereof.

U.S. Pat. No. 5,067,058

Inventor: Michael P. Standley

Issued: Nov. 19, 1991

An improved skateboard having roller trucks attached to the underside of the skateboard deck. The trucks are insulated from the skateboard deck by riser pads of sufficient thickness to receive and house self-contained battery operated lamps. The lamps are positioned to direct light beams from beneath the deck in fore and aft directions. Switch means in the lamps are operable to turn the lamps on and off.

U.S. Pat. No. 5,132,883

Inventor: Monroe A. La Lumandier

Issued: Jul. 21, 1992

An illuminated railing for attachment to a skateboard as a bumper for protecting the bottom of the board or the ends thereof or the like. The railing is formed from a bar with externally viewable lights. The lights are connected to a circuit which includes a battery and a way to break the circuit. For use as a replacement part, the bar is preferably flexible and symmetrical to minimize the number of parts which must be stocked.

U.S. Pat. No. 5,292,148

Inventor: Ekedal et al

Issued: Mar. 8, 1994

A skateboard comprising a rotatable disk mounted on the top surface of the skateboard's riding platform surface for rotatably maneuvering the skateboard in different directions. The skateboard may include front and rear illumination sources mounted within respective front and rear housings secured to the underside of the riding platform.

U.S. Pat. No. 5,475,572

Inventor: Shen-Ko Tseng

Issued: Dec. 12, 1995

A light emitting roller for roller skates, including a roller body having a center axle hole for mounting on a wheel axle, an annular groove around the center axle hole at an outer side, a battery chamber and two opposite through holes at the annular groove; an annular circuit board mounted within the annular groove on the roller, having a plurality of light emitting elements controlled to emit light through the through holes on the roller body, an automatic switch, an opening, two contact metal plates at two opposite sides of the opening, and a battery cell connected between the contact metal plates and mounted within the battery chamber on the roller to provide electric power supply to the light emitting elements through the automatic switch; and an annular cap mounted within the annular groove on the roller to hold down the annular.

U.S. Pat. No. 5,513,080

Inventor: Thomas O. Mangle et al.

Issued: Apr. 30, 1996

A lighting kit that provides indirect lighting for roller skates or skateboards by mounting a lighting assembly under the shoe section of the skate or underside of the skateboard and providing a light directed down from the bottom of the shoe section of the skate or underside of the skateboard to the floor under the user. The color of the lighting system can be altered by placing a color filter in front of the lamp. In an alternative embodiment the conventional lamps used in the first embodiment are replaced by electroluminescent (EL) lamps. The EL lamps provide a flat structure which is relatively unnoticeable to observers when the skate is in use and the lamps turned off because they are positioned flat against the bottom of the skate or skateboard. When the lamps are activated, they illuminate the floor beneath the skate but are not directly seen. The third embodiment provides flat EL lamp panels which removably attach to the sides of the skates or skateboards such that they can be used not only for aesthetic reasons but also to provide an effective safety measure. The kit can be manufactured with the skate or skateboard as an integral component.

U.S. Pat. No. 5,580,093

Inventor: Pervis Conway

Issued: Dec. 3, 1996

The improved light generating and emitting roller skate wheel assembly of the present invention includes a wheel axle assembly carried by and beneath the roller skate blade. Such wheel axle assembly includes wheel bearings which are disposed thereon. A wheel hub is mounted on the wheel axle assembly and supported by the wheel bearings for rotational movement relative thereto. A tire, preferably made of a clear polymer is disposed about the wheel hub assembly. The roller skate wheel carries a light emitting mechanism, such as a light emitting diode, for emitting visible light preferably through the clear, polyurethane elastomer tires, as used in certain preferred embodiments. The roller skate wheel carries an electrical light generator which is electrically connected to the light emitting diode or other light emitting mechanism for providing electric energy and for generating light therefrom. The details of these structures are described in greater detail hereinbelow.

U.S. Pat. No. 5,718,499

Inventor: Frank De Caro

Issued. Feb. 17, 1998

A new Roller Blade Wheel Lighting System for increasing the visibility of the user when roller blading in darkness, without requiring an external power source. The inventive device includes a transparent cylindrical plastic rim rotatably secured to a conventional blade support member of a roller blade, an illuminating means positioned within the transparent cylindrical plastic rim, and a hard rubber rim secured around the transparent cylindrical plastic rim juxtaposed to the blading surface.

SUMMARY OF THE PRESENT INVENTION

The present invention relates generally to recreational devices and, more specifically, to an illuminated recreational skateboard or snowboard including a flat surface having a plurality of recesses made in the peripheral edge of the surface whereby a plurality of LED's may be placed in respective recesses to provide optical displays. Additionally, a transparent or pigmented lining formed from a polymeric substance can be placed over the LED's for protecting the LED's or diffracting light illuminating from the LED's.

A primary object of the present invention is to provide an illuminating skateboard or snowboard which overcomes the shortcomings of the prior art.

Another object of the present invention is to provide an illuminating skateboard or snowboard having a plurality of LED's surrounding its periphery.

A yet further object of the present invention is to provide an illuminating skateboard or snowboard wherein the power source functions as a riser for attaching a wheelbase to a surface thereof or is housed within a riser.

Still yet another object of the present invention is to provide an illuminating skateboard or snowboard including a protective lining surrounding the periphery of the surface.

Another object of the present invention is to provide an illuminating skateboard or snowboard that is able to produce a plurality of different optical displays using LED's and the protective lining.

Yet another object of the present invention is to provide an illuminating skateboard or snowboard able to regulate a flow of power from the power source to the LED's.

Still yet another object of the present invention is to provide an illuminating skateboard or snowboard able to control the LED's to flash or light up in any of a plurality of patterns.

Additional objects of the present invention will appear as the description proceeds.

The present invention overcomes the shortcomings of the prior art by providing an illuminating skateboard or snowboard having a plurality of LED's placed within recesses along a peripheral edge of the board. The LED's are covered with a protective lining which may be transparent or tinted to provide a desired intensity or color of illumination and a plurality of differentiating optical displays. Additionally, a power source is integrated into a wheel mount of the skateboard and controls the illumination of the LED's. A power source is positioned on a upper surface of a snowboard in a non burdensome location.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims. The following detailed description is, therefore, not to be taken in a limiting sense, and the scope of the present invention is best defined by the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

Figure 1:
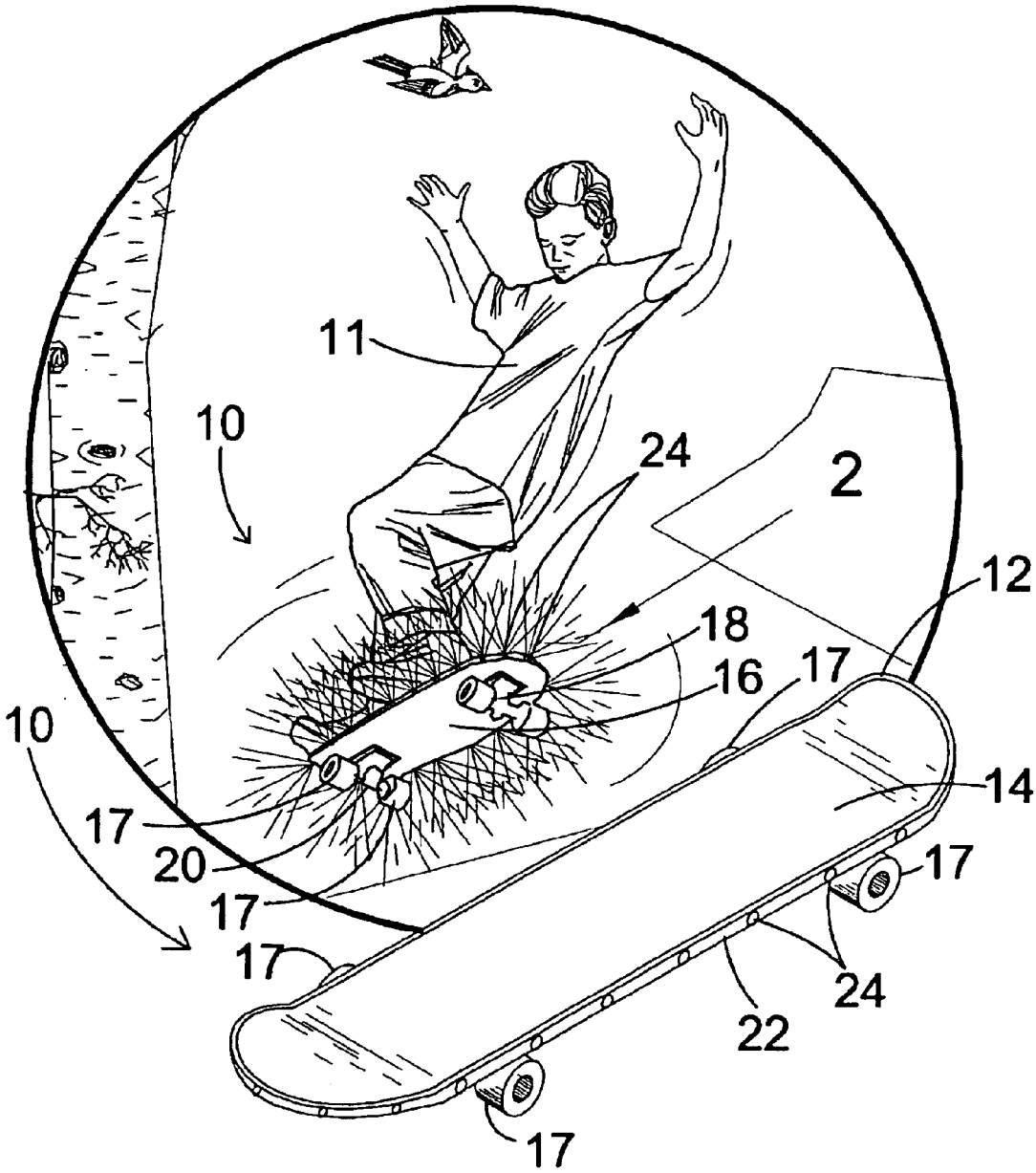
FIG. 1 is a perspective view of a user riding the illuminated recreational board of the present invention when fitted to be formed as a skateboard.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to those skilled in the art to practice the invention, and it is to be understood that other embodiments may be utilized and that structural changes may be made without departing from the scope of the invention. In the accompanying drawings, like reference characters designate the same or similar parts throughout the several views.

DESCRIPTION OF THE REFERENCED NUMERALS

Turning now descriptively to the drawings, in which similar reference characters denote similar elements throughout the several views, the Figures illustrate the recessed lighting of the present invention for application with both skateboards and snowboards. With regard to the reference numeral used, the following numbering is used throughout the various drawing figures.

10 illuminated recreational board of the present invention
11 user
12 board
14 topside of the board
16 bottom side of the board
17 bearing-centered wheel
18 front wheel assembly
20 rear wheel assembly
22 peripheral edge of the board
24 a plurality of LED's
26 chuck
28 chuck baseplate
30 recess
32 screw
34 riser
35 central cavity of riser

36 axel
38 wiring
40 protective lens
42 protective band
43 LED circuit
44 battery pack
46 battery compartment
48 power switch
50 battery compartment door
52 battery
54 battery recess
56 power switch recess
58 flash circuitry
60 strobe circuitry
62 twinkle circuitry
64 constant illumination circuitry
66 snowboard
68 top side of snowboard
70 bottom side of snowboard
72 peripheral edge of surface
74 bindings

DETAILED DESCRIPTION OF THE PREFERRED EMBODIMENT

Turning now descriptively to the drawings, in which similar reference characters denote similar elements throughout the several views, FIGS. 1 through 9 illustrate illuminated recreational board of the present invention indicated generally by the numeral 10.

FIG. 1 is an illustrated view of a user 11 riding the illuminated skateboard 10 of the present invention. The illuminated skateboard 10 includes a board 12. The board 12 includes a first end and a second end. The board 12 is of a length between the first and second end long enough to accommodate the feet of a person standing thereon. The board 12 further includes a top side 14 on which a user 11 is positioned while riding, and a bottom side 16. Wheels 17 are mounted to the board 12 on the bottom side 16. A front wheel assembly 18 is mounted near the first end on the bottom side 16 of the board 12. A rear wheel assembly 20 is mounted to the bottom side 16 of the board 12 positioned a distance away from the front assembly 18 adjacent the second end of the board 12. The board 12 has a thickness and extending around a periphery of the board 12 are a plurality of recesses. The illuminated recreational board 10 further includes a plurality of LED's 24. Each of the plurality of LED's 24 is received within a respective one of the plurality of recesses 25 along the peripheral edge 22 of the board 12. A power source is preferably mounted within either the front or rear wheel assembly 18 or 20 respectively for providing power to the plurality of LED's. A snap on protective cover selectively covers and protects the plurality of LED's 24. The protective cover may either be a strip of transparent or tinted material extending around the periphery of the board 12 and covering the LED's 24 or a plurality of individual covers, each being received within a respective recess for covering and protecting individual LED's. Non-functioning LED's 24 are easily replaced or customized by selectively placing replacement bulbs in the sockets. The covers may be clear or tinted for providing an additional customizing feature. The LED's 24 as well as the connecting wires are embedded within the board 12 thereby maintaining the structural integrity of the board 12 and protecting the LED's 24 and wiring from destruction during use of the illuminated recreational board 10.

Figure 2:
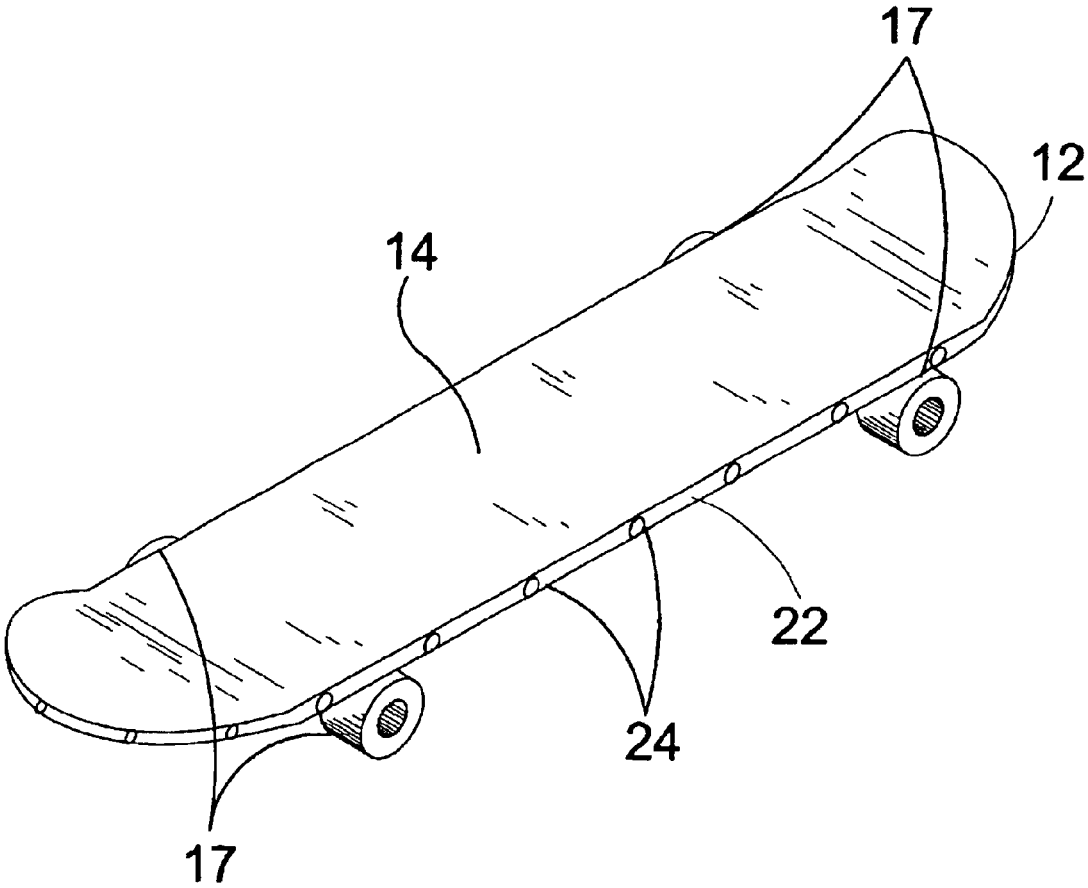
FIG. 2 is a top perspective view of the illuminated recreational board of the present invention.

FIG. 2 is a top perspective view of the illuminated recreational board 10 of the present invention. Shown is an illuminating recreational board 10 including a board 12. The board 12 is of a length able to accommodate a user's feet. The board 12 has a width including the plurality of recesses extending into the periphery thereof. The plurality of LED's 24 are received with in the respective recesses along the peripheral edge 22. The size, shape, and spacing of the LED's 24 may vary depending on the design of the particular skateboard.

The board 12 is includes two sets of wheels 17 secured to the bottom side 16. The first set of wheels 17 is connected to the front wheel assembly 18 near the first end of the board 12 and a second set of wheels 17 are connected to the rear wheel assembly 20 attached to the opposite end of the board 12. The wheels 17 are aligned so that the axis of rotation of the front wheel assembly 18 is parallel to the axis of rotation of the rear wheel assembly 20. Both axes are aligned to extend perpendicularly to the length of the board 12. The illuminating recreational board 10 rolls on its wheels 17 in a direction perpendicular to the axis of rotation of the wheel assemblies 18 and 20.

Figure 3:
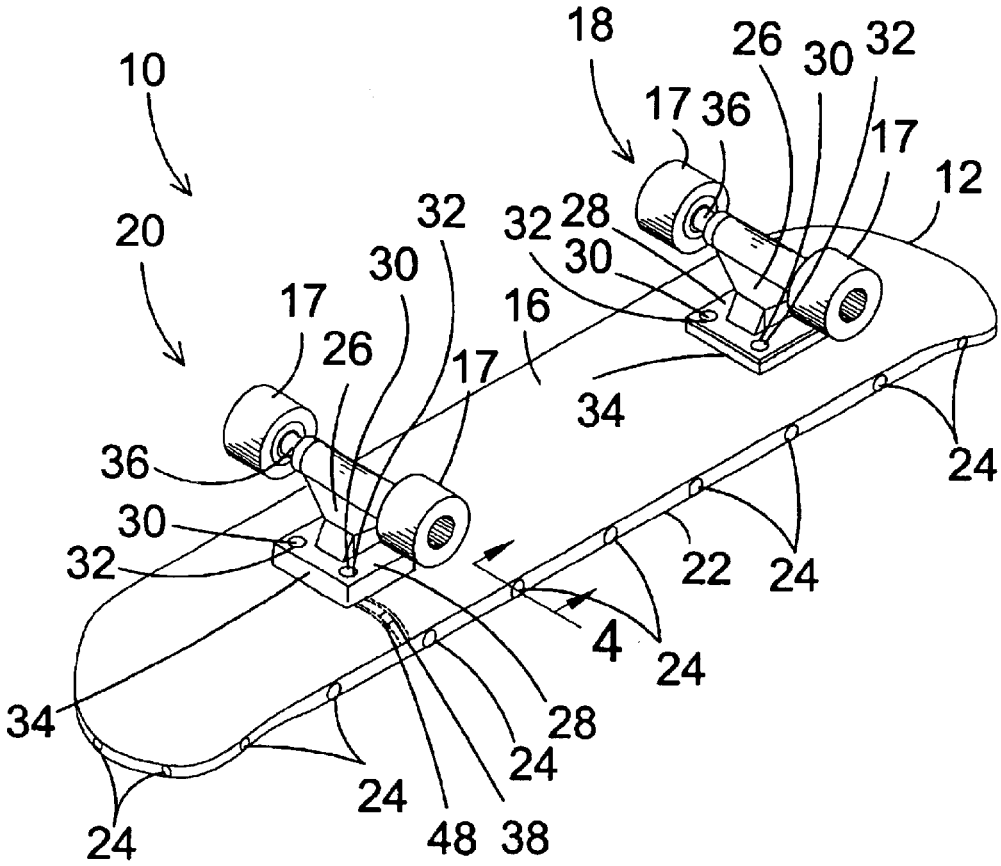
FIG. 3 is bottom perspective view of the illuminated recreational board of the present invention.

FIG. 3 is bottom view of the illuminated skateboard 10 of the present invention. Shown is the bottom side 16 of the board 12 including the front and rear wheel assemblies, 18 and 20 respectively, mounted thereto. Each wheel assembly 18 and 20 includes a chuck 26, a riser 34, an axel 36, and a pair of bearing-centered wheels 17. The chuck 26 connects the wheel assemblies 18 and 20 to the board 12. The chuck 26 has a bracket with an axel 36 extending therethrough and a baseplate 28 for connecting to the board 12. Wheels 17 are mounted to either end of the axel 36 extending through the chuck 26. The chuck 26 is mounted to the riser 34. The riser 34 is cubically shaped and preferably made from hard plastic or rubber. The riser 34 acts as a shock absorber and provides a flat surface for mounting the chuck 26. The chuck 26 is connected to the riser 34 by at least one screw 32. The at least one screw 32 extends through a respective hole 30 in the base plate 28 of the chuck 26. The baseplate 28 has a plurality of holes 30 positioned along the perimeter thereof By mounting the chuck 26 to the riser 34 with screws 32 along the perimeter of the baseplate 28, the central portion of the riser 34 is unobstructed for holding a power source therein. The preferred embodiment of the power source includes a battery, mounted within the riser 34, as a power source for the LED's 24. However, any power source able to provide power to illuminate the plurality of LED's 24 may be used. The LED's 24 are shown positioned within recesses along the peripheral edge 22 of the board 12. The LED's 24 are connected to the battery (not illustrated) by wiring 38 extending therebetween and positioned within the board 12. A power switch 48 extends from the bottom side 16 of the board 12 and selectively connects the power source to the LED's through connecting wiring 38. The wiring 38 and the power switch 42 are purposely positioned above a wheel 17 to decrease the risk of damage such as by being struck by objects passing underneath the illuminated recreational board 10. The power switch 48 has multiple settings, each setting corresponds to a unique illumination pattern for the LED's 24. For example, the user may selectively control the LED's 24 to illuminate in a constant steady fashion, twinkle, flash, strobe, or remain off by placing the power switch 48 in the desired position. While the present embodiment describes a battery as the power source, an alternate embodiment includes a generating device connected to the wheels 17 for converting rotational kinetic energy into electric energy.

Figure 4:
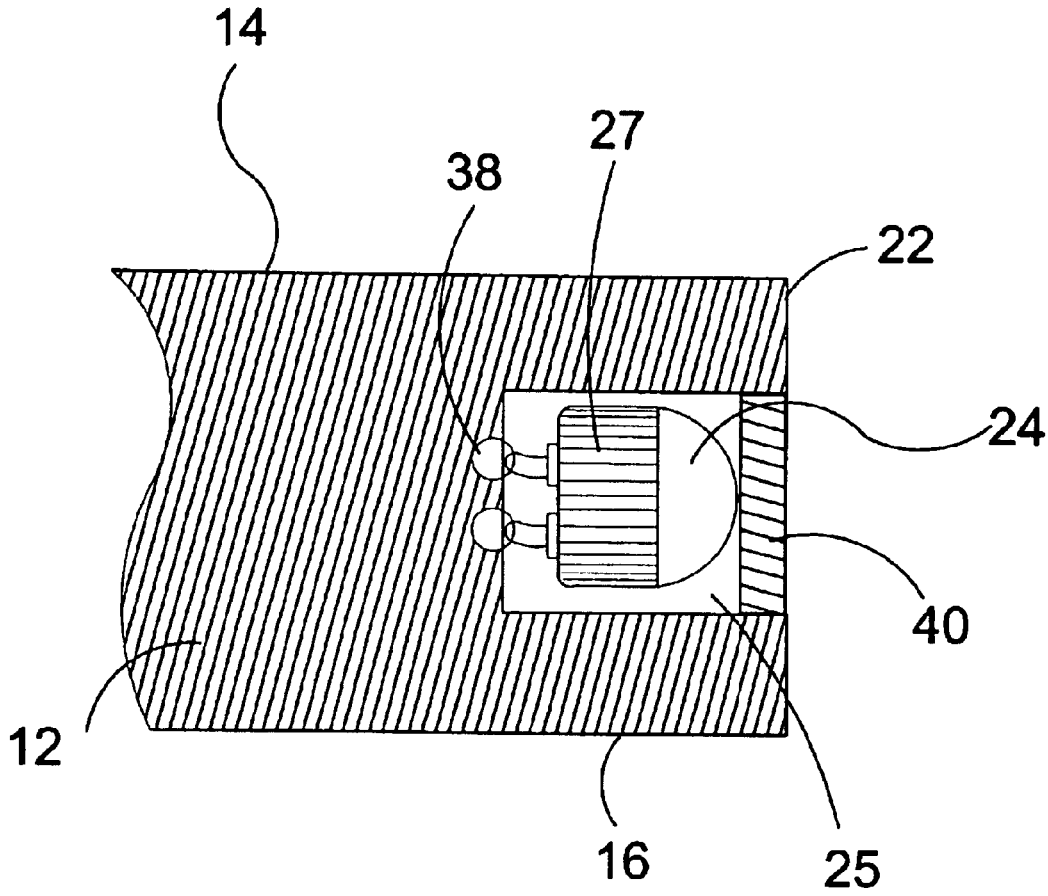
FIG. 4 is a cross sectional view of the illuminated recreational board of the present invention taken along line 4—4 of FIG. 3 showing an LED mounted within the deck.

FIG. 4 is a cross sectional view of the illuminating recreational board taken along line 4—4 of FIG. 3. This Figure shows an LED 24 mounted within the board 12. The recess 25 is formed in the peripheral edge 22 of the board 12 between the top and bottom sides, 14 and 16 respectively. The recess 25 extends from an appropriate distance into the board 12 for accommodating an LED 24. Wiring 38 extends within the board 12 to connect the LED 24 to the power source. A socket 27 is positioned within each recess 25 and connected to the wiring 38. An LED 24 is inserted into the socket 27. The wiring 38 extends from the power source and into each recess 25 for connecting to each LED through its respective socket 27. Each LED 24 is readily replaceable if the bulb should burnout or a differently colored bulb is desired by simply removing the LED 24 from its respective socket 27 and replacing the LED 24. A protective cover 40 is positioned to extend around the peripheral edge of the board 12 thereby covering all of the recesses 25. The protective cover 40 is formed by a transparent material allowing light of illuminated LED's 24 to pass therethrough while also protecting the LED 24 and wiring 38. The protective cover 40 may have various tints and etchings for creating a different color or brightness of light produced by the LED's 24. The cover 40 is removable for repairing the bulb 24 and wiring 38 within the recesses 25 or for replacing with a cover 40 having a different tint or etching for creating a desired appearance.

Figure 5:
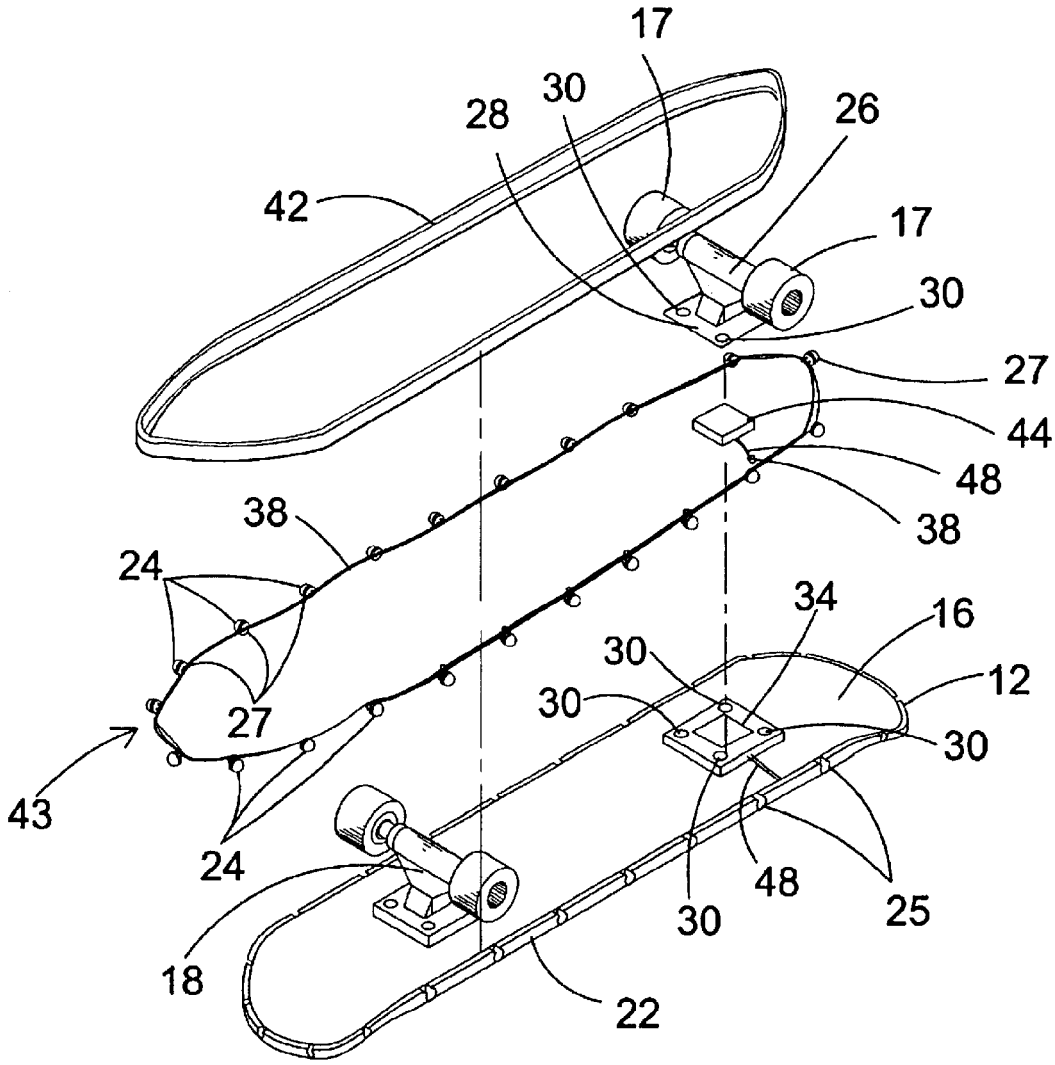
FIG. 5 is an exploded bottom perspective view of the illuminated skateboard of the present invention.

FIG. 5 is an exploded bottom perspective view of the illuminated skateboard 10 of the present invention. Shown is the bottom side 16 of the board 12. The plurality of recesses 25 are positioned around the peripheral edge 22 of the board 12 extending into the board 12. The number of recesses 25, the position of each recess 25 and the size of each recess 25 is dependent upon the design of the particular skateboard. The LED circuit 43 including wiring 38, sockets 27, LED's 24, and a control box 44 is received within the board 12 whereby each LED 24 is received within a respective recess 25. A plurality of sockets 27 are positioned along wiring 38 whereby each socket 27 is aligned with each of the plurality of recesses 25 positioned on the board 12. Each socket 27 receives a removable LED 24. The wiring 38 connects the sockets 27 to the control box 44. The control box 44 contains a power source and circuitry for illuminating the LED's in any desired fashion to create various patterns of illumination. The control box 44, as illustrated, is a housing sized to fit into the center of the riser 34 of the rear wheel assembly 20. The control box 44 is secured between the chuck 26 and the bottom side 16 of the board 12. The power switch 48 for selectively activating the LED's 24 and selecting a desired pattern of illumination of the LED's 24 is connected to the wiring 38. The power switch 48 has various on positions, each position connects the LED circuit 43 to the power source via a circuitry corresponding to a unique pattern of illumination of the LED's 24. For example, the LED's 24 may illuminate in a constant fashion or the LED's 24 may be set to flash, twinkle or strobe.

The illustrated embodiment also includes a single continuous, transparent, protective band 42 shaped to fit snugly around the peripheral edge 22 of the board 12 and thereby selectively cover and protect the LED's 24 within each recess 25. Alternatively, individual protective covers 40 may be attached to cover each respective recess 25 and thereby protect each LED 24 in the respective recesses 25, as shown in FIG. 4. The protective band 42 is slid over the edge 22 of the board 12 after installing the LED circuit 43. The protective band 42 diffuses light emanating from the plurality of LED's 24, thus creating a continuous band of light. Additionally, the protective band 42 encloses the recesses 25, preventing water and dirt from entering and damaging the plurality of recesses 25. The protective band 42 may be provided in a variety of colors or tints for altering the color of light emanating from the LED's 24 to a desired color. The protective band 42 may be readily slid off of the board 12 for repairing the LED circuit 43 or individual bands. The protective band 42 is also easily replaced with a differently tinted band 42 to thereby change the color of illumination.

Figure 6:
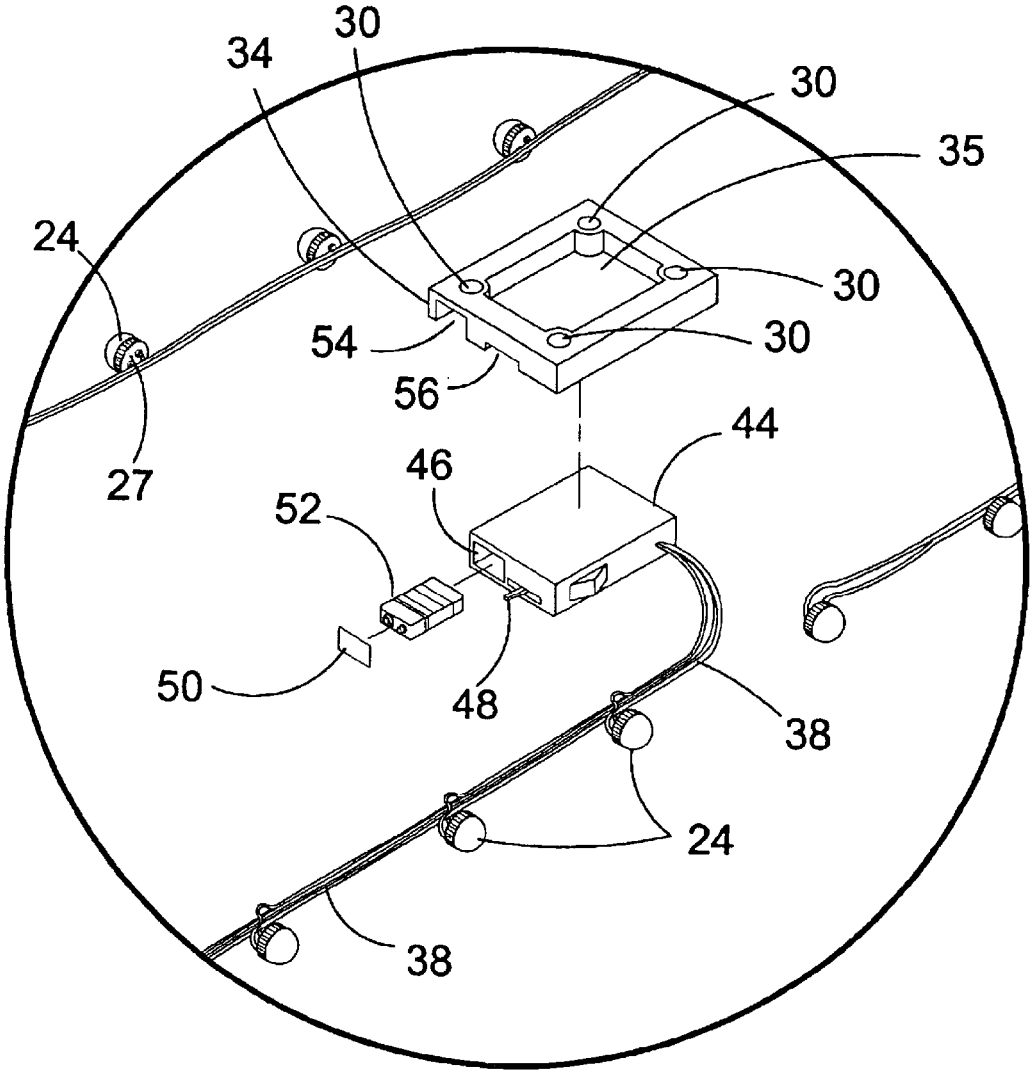
FIG. 6 is an exploded view of a riser and control box of the rear assembly of the illuminated recreational board of the present invention.

FIG. 6 is an exploded view of a riser 34 used with the illuminated recreational board 10 of the present invention. The riser is able to provide access to the power switch 48 therethrough. Shown is an LED circuit 43 including wiring 38, sockets 27, LED's 24, and a control box 44. A plurality of sockets 27 are positioned along the wiring 38 so that each socket 27 is aligned with each of the plurality of recesses 25 positioned on the board 12. Each socket 27 is able tro receive a removable LED bulb 24. The wiring 38 connects the sockets 27 to the control box 44. The control box 44 contains circuitry for selectively illuminating any desired sequence of LED's thereby creating various patterns of illumination. Also contained within the control box 44 is a battery compartment 46 and a power switch 48. The battery compartment 46 and power switch 48 are positioned on a side of the control box 44 that extends perpendicularly from the board 12. Such placement allows for access to the power source 52 and the power switch 48 through the riser 34. The riser 34 contains a battery recess 54 and a switch recess 56 located in positions corresponding to the placement of the battery pack 46 and power switch 48. Through the battery recess 54, the removable battery door 50 may be accessed for replacing the battery when necessary. Additionally, the power switch 48 extends beyond the switch recess 56. The control box 44, as illustrated, is a housing sized to fit into the center of the riser 34 of the rear wheel assembly 20. The control box 44 is secured between the chuck 26 and the bottom side 16 of the board 12. The power switch 48 is user activated to illuminate the LED's 24 in a desired pattern or sequence. The power switch 48 has numerous positions, each position connecting the LED circuit 43 to the battery in a manner to create a unique pattern or sequence of illumination of the LED's 24. For example, the LED's 24 may illuminate in a constant fashion or the LED's 24 may be set to flash, twinkle or strobe.

Figure 7:
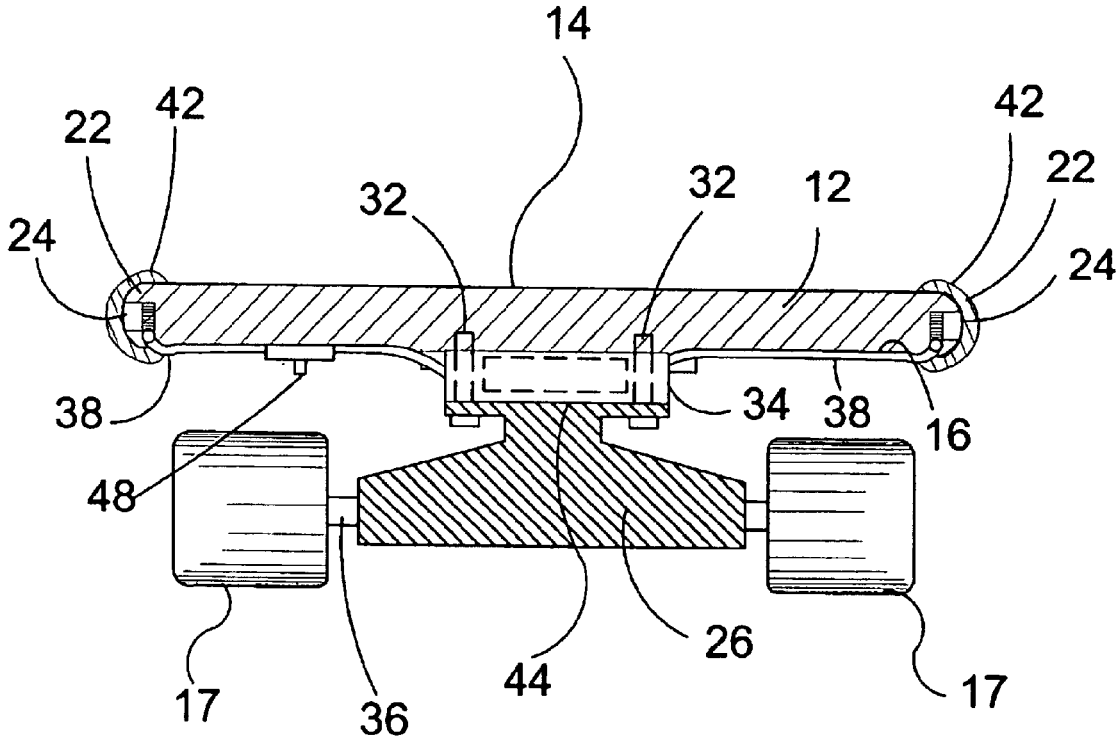
FIG. 7 is a cross sectional view of the rear wheel assembly and deck of the illuminated recreational board of the present invention.

FIG. 7 is a cross sectional view of the rear wheel assembly 20 and board 12 of the illuminated recreational board 10 of the present invention. Shown is a board 12 having the top side 14, bottom side 16 and peripheral edge 22. Mounted to the bottom side 16 is the riser 34 and chuck 26. The chuck 26 is a bracket through which an axle 36 extends. Bearing centered wheels 17 are mounted on either end of the axle 36. The chuck 26 has the baseplate 28. Shown are two screws 32 extending through corresponding holes 30 in the baseplate 28 to secure the chuck 26 and riser 34 to the board 12. The riser 34 acts as a shock absorber and provides a flat surface for mounting the baseplate 28 of the chuck 26 thereto. Concealed within the central cavity of the riser 34 is a control box 44. The control box 44 includes the housing as well as the battery pack and circuitry for modifying the illumination pattern contained within the housing. Wiring extends from the control box 44 toward the peripheral edge 22 of the board 12 for connecting the plurality of LED's 24 to the power source. The plurality of LED's 24 illuminate the board 12 when the power switch 48 is in an on position. Each LED 24 is received within a respective recess 25 within the peripheral edge 22 of the board 12. The protective band 42 is positioned to cover the peripheral edge 22 of the board 12 and thereby protect the LED's 24 and circuitry. In addition, the protective band 42 retracts or reflects the light illuminated from the individual LED's 24 thus creating a continuous band of light around the board 12. A power switch 48 is mounted to the bottom side 16 of the board 12 for selectively connecting the control box 44 to the plurality of LED's 24.

Figure 8:
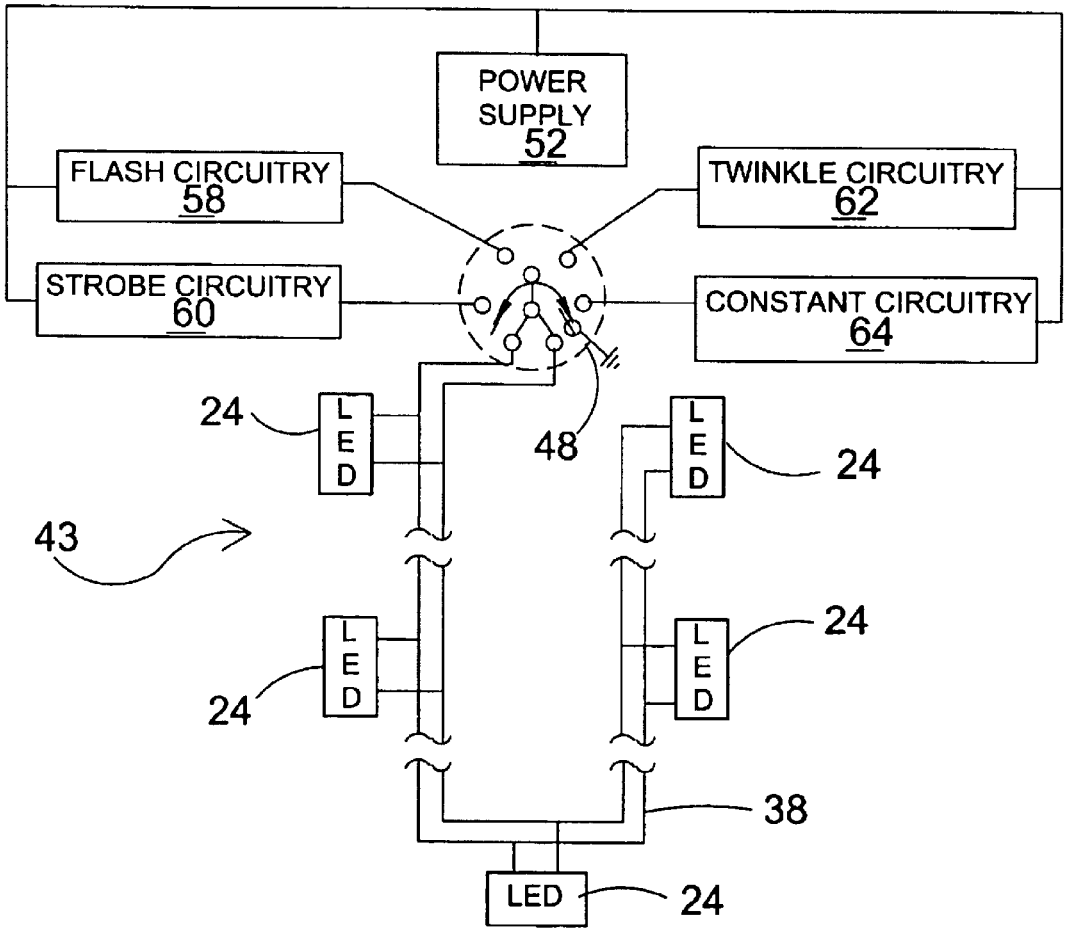
FIG. 8 is a block diagram illustrating the electrical connections of the components of the LED circuit of the illuminated recreational board of the present invention.

FIG. 8 is a block diagram illustrating the electrical connections of the components of the LED circuit 43 of the illuminated recreational board 10 of the present invention. Shown is an LED circuit 43 consisting of wiring 38, a plurality of LED's 24, a power switch 48, a power supply 52, and four unique circuits for altering the pattern of illumination of the LED's 24, including a flash illumination circuit 58, a strobe illumination circuit 60, a twinkle illumination circuit 62, and a constant illumination circuit 64. The power source is preferably in the form of a battery pack 52 as illustrated in the previous Figures, or a generator that converts rotational kinetic energy provided by the wheels into electrical energy. Alternatively, any power source able to illuminate the LED's 24 may be used. Electrically connected to the power source are four unique circuits, each circuit alters the pattern or sequence of illumination of the LED's 24. Each circuitry is connected to a separate terminal of the power switch 48. The power switch 48 in this instance is a five-position switch. The first position disconnects the plurality of LED's 24 from the power source. The second position connects the LED's 24 to the strobe circuit 60. The third position connects the LED's 24 to the flash circuit 58. The fourth position connects the LED's to the twinkle circuit 62. The fifth position connects the LED's 24 to the constant circuit 64. The switch 48 allows the plurality of LED's 24 to be selectively connected with the power source. Connecting the switch 48 to any 7 of the illumination circuits draws electrical current through the wiring 38 via the connected circuitry for illuminating the LED's 24. If the terminal connected to the flash circuitry 58 is contacted by the power switch 48, the LED's 24 will flash on and off in unison. If the terminal connected to the strobe circuitry 60 is contacted, the LED's 24 will illuminate in a progressive series along the wiring 38 appearing as if a single LED 24 is illuminated and being slid along the wiring 38. If the terminal connected to the twinkle circuitry 62 is contacted, the LED's 24 will illuminate in a seemingly random pattern, with different durations of illumination appearing at different locations in a non-sequential order. If the terminal connected to the constant illumination circuitry 64 is contacted, the LED's 24 will all continuously illuminate in unison. The plurality of LED's 24 may be turned off by removing the power switch 48 from contacting any of the second, third, fourth, or fifth terminals.

Figure 9:
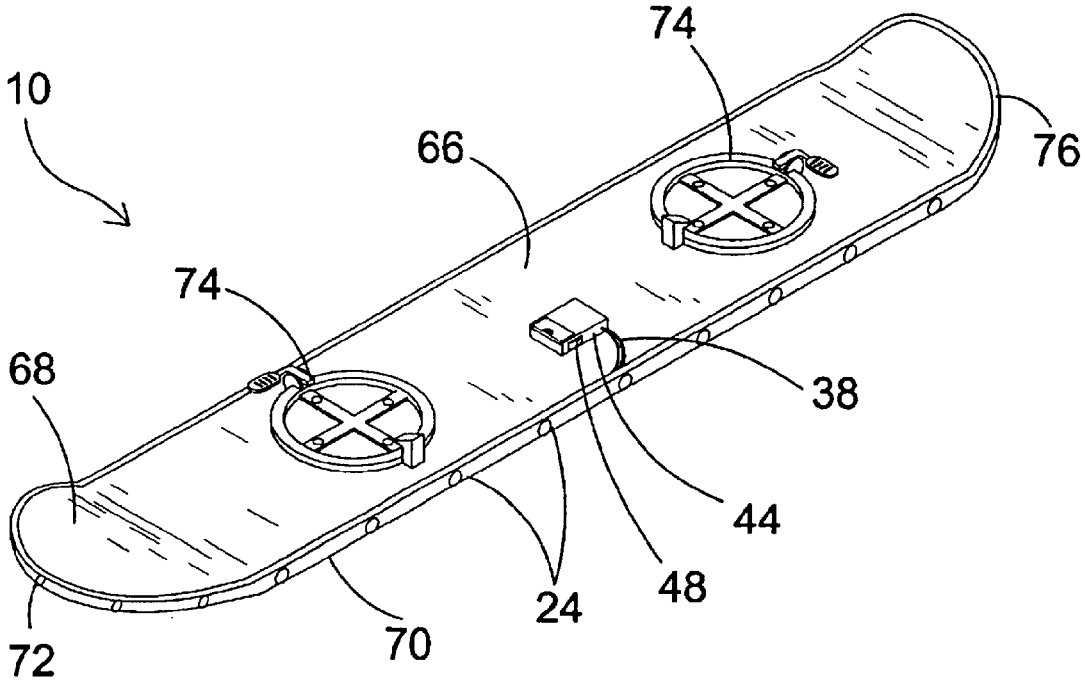
FIG. 9 is a perspective view of the illuminated recreational board of the present invention.

FIG. 9 is a perspective view of the illuminated recreation board 10 of the present invention designed as a snowboard. The configuration and operation of the illuminated recreational board 10 when embodied as a snowboard 66 is similar to that described herein before with reference to the skateboard, the difference being the positioning of the necessary elements of the illuminated board 10. The snowboard 66 has a top side 68, a bottom side 70 and a peripheral edge 72. Shown is the top side 68 of a snowboard 66. The bottom side 70 of the snowboard 66 is substantially flat and smooth for sliding on snow. Mounted on the top surface 68 of the snowboard are bindings 74 for snapping boots therein to releasably secure the user to the snowboard 66. Recesses are positioned about the peripheral edge 72 of the snowboard 66. A socket 27 is received within each of the plurality of recesses 25 and an LED 24 is received within each socket 27. The LED's 24 are interconnected by wiring 38 which extends to a control box 44. The control box 44 contains a battery 52 and a power switch 48 for selectively connecting the LED's 24 to the power source. The control box 44 is mounted on the top surface 68 of the snowboard 66, preferable between the bindings 74. Such placement of the control box 44 is intended to prevent damage and minimize exposure of the battery pack. The plurality of LED's 24 are covered with a protective layering 76. The protective layering 76 may be similar in form to the protective band illustrated in FIG. 5 and referenced as numeral 42, or may be formed by a transparent layer of hardened wax. Alternatively, a plurality of protective covers may each be positioned to cover a respective recess and thereby protect the LED's 24 within the recess 25. The power switch 48 and circuitry connected thereto 43 may be provided as discussed in FIG. 8.

From the above description it can be seen that the illuminated recreational board of the present invention is able to overcome the shortcomings of prior art devices by providing an LED circuit extending around the peripheral edge of a skateboard or a snowboard without requiring the addition of slide pads or other external apparatuses. Furthermore, the illuminated recreational board of the present invention conceals the control box of the present invention within a rear riser such that the riser is secured between the wheel assembly and the underside of the deck. Such mounting of the control box within the rear riser secures the control box and snowboard of the present invention. Furthermore, the illuminated recreational board of the present invention is simple and easy to use and economical in cost to manufacture.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An illuminated recreational board, comprising:

a) a board including a top side, bottom side and peripheral side extending between said top and bottom sides;

b) plurality of recesses extending into said peripheral side;

c) a plurality of removable LED's, each of said plurality of LED's positioned within a respective one of said plurality of recesses;

d) a transparent cover positioned on said peripheral side for protecting and covering said plurality of LED's within said plurality of recesses;

e) means for illuminating said plurality of LED's;

f) a first wheel assembly and a second wheel assembly secured on said bottom side of said board, each of said first and second assemblies including an axle, a chuck through which said axle extends, first and second wheels attached to opposing ends of said axle, a riser connected between said chuck and said bottom side of said board, said riser being made of material capable of acting as a shock absorber for said chuck; and a baseplate attached to said chuck for mounting said chuck to said riser and board, with said riser between an axle and said board; and g) said riser including a central cavity for accommodating said illuminating means which is thereby protected against damage by objects passing underneath said board.

2. The illuminated recreational board as recited in claim 1, where said illuminating means includes a power source and a switch, said plurality of LED's being connected through connecting wires embedded within said board to said power source via said switch, and said riser includes a first recess for receiving said power source, and a second recess through which said switch extends for selectively controlling said power source to selectively illuminate said plurality of LED's.

3. The illuminating recreational board as recited in claim 1, further comprising a plurality of sockets, each of said plurality of sockets being positioned within a respective one of said plurality of recesses for receiving a respective one of said plurality of LED's.

4. The illuminating recreational board as recited in claim 3, wherein said transparent cover includes a band having a circumference substantially equal to a circumference of said peripheral edge of said board; said band being selectively positioned over said peripheral edge of said board for covering and protecting said plurality of LED's.

5. The illuminating recreational board as recited in claim 3, wherein said transparent cover includes a plurality of individual covers, each of said plurality of individual covers being positioned over a respective one of said plurality of recesses for protecting and covering a respective one of said plurality of LED's.

6. The illuminated recreational board as recited in claim 3, wherein said switch includes a plurality of position, each of said plurality of positions illumination said plurality of LED's in a predetermined sequence.

7. The illuminated recreational board as recited in claim 6, wherein said predetermined sequences including a flashing pattern of illumination, a strobing pattern of illumination, a twinkling pattern of illumination and a constant and continuous illumination of said plurality of LED's.

8. An illuminated snowboard, comprising:

a) a board including a top side, bottom side and peripheral side extending between said top and bottom sides;

b) plurality of recesses extending into said peripheral side;

c) a plurality of removable LED's, each of said plurality of LED's positioned within a respective one of said plurality of recesses;

d) a transparent cover positioned on said peripheral side for protecting and covering said plurality of LED's within said plurality of recesses; and e) a first binding and a second binding, said first and second bindings being secured to said top side of said board for selectively mounting a user's feet to said board, f) means for illuminating said plurality of LED's comprising a control box mounted on the top side of said board between the first and second bindings.

9. The illuminated snowboard as recited in claim 8, wherein said bindings are mounted at a distance substantially equal to a distance between the shoulders of the user.

10. The illuminated snowboard as recited in claim 9, wherein said illuminating means includes a power source and a switch within said control box, said plurality of LED's being connected to said power source via said switch.

11. The illuminating snowboard as recited in claim 10, further comprising a plurality of sockets, each of said plurality of sockets being positioned within a respective one of said plurality of recesses for receiving a respective one of said plurality of LED's.

12. The illuminating snowboard as recited in claim 11, wherein said transparent cover includes a band having a circumference substantially equal to a circumference of said peripheral edge of said board; said band being selectively positioned over said peripheral edge of said board for covering and protecting said plurality of LED's.

13. The illuminating snowboard as recited in claim 11, wherein said transparent cover includes a plurality of individual covers, each of said plurality of individual covers being positioned over a respective one of said plurality of recesses for protecting and covering a respective one of said plurality of LED's.

14. The illuminated snowboard as recited in claim 11, wherein said switch includes a plurality of positions, each of said plurality of positions illumination said plurality of LED's in a predetermined sequence.

15. The illuminated snowboard as recited in claim 14, wherein said predetermined sequences including a flashing pattern of illumination, a strobing pattern of illumination, a twinkling pattern of illumination and a constant and continuous illumination of said plurality of LED's.

* * * * *